US010165860B2

(12) United States Patent
Hawkins et al.

(10) Patent No.: US 10,165,860 B2
(45) Date of Patent: Jan. 1, 2019

(54) COSMETIC DOOR PANEL SUSPENSION AND ADJUSTMENT SYSTEM FOR A BUILT-IN APPLIANCE

(71) Applicant: WHIRLPOOL CORPORATION, Benton Harbor, MI (US)

(72) Inventors: Trevor L. Hawkins, Belle Plaine, IA (US); Scott A. Kositzky, Cedar Rapids, IA (US); Chad Rotter, Amana, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 35 days.

(21) Appl. No.: 15/149,218

(22) Filed: May 9, 2016

(65) Prior Publication Data

US 2017/0318965 A1 Nov. 9, 2017

(51) Int. Cl.
*A47B 96/20* (2006.01)
*F25D 23/02* (2006.01)

(52) U.S. Cl.
CPC ..... *A47B 96/20* (2013.01); *F25D 23/028* (2013.01); *A47B 2096/208* (2013.01)

(58) Field of Classification Search
CPC ..... F25D 2400/18; A47B 2096/208; A47B 96/20
See application file for complete search history.

(56) References Cited

U.S. PATENT DOCUMENTS 3,178,664 A * 4/1965 Thoele ..... H01C 10/20 338/131
3,871,076 A * 3/1975 Perry ..... B26B 21/32 30/60.5
3,968,708 A * 7/1976 Ingersoll ..... B25B 13/14 81/157
5,147,124 A 9/1992 Grass et al.
6,079,164 A * 6/2000 Lanzani ..... A47L 15/4251 248/316.1
6,536,856 B2 * 3/2003 Pelizzari ..... A47L 15/4265 248/287.1
6,692,093 B1 * 2/2004 Park ..... F16M 11/10 312/319.7
8,382,219 B2 * 2/2013 Hottmann ..... A47B 88/95 312/348.4

(Continued)

FOREIGN PATENT DOCUMENTS

DE 3218837 11/1983
WO 2010076200 7/2010
WO 2013182428 12/2013

*Primary Examiner* — Catherine A Kelly
(74) *Attorney, Agent, or Firm* — Price Heneveld LLP

(57) ABSTRACT

A cosmetic panel suspension system for an appliance includes an outer door panel having a perimetrical flange. A plurality of side adjusters is attached to the perimetrical flange. At least one adjustment bracket has a plurality of positioning apertures in slidable engagement with a portion of the perimetrical flange. The plurality of side adjusters extends through respective positioning apertures defined within the at least one adjustment bracket, and adjustment of at least one side adjuster of the plurality of side adjusters slides the at least one adjustment bracket relative to the perimetrical flange. A cosmetic panel is attached to the at least one adjustment bracket.

14 Claims, 8 Drawing Sheets

(56) References Cited

U.S. PATENT DOCUMENTS

| | | | | |
|---|---|---|---|---|
| 8,485,615 | B2 * | 7/2013 | Ciyanoglu | A47B 77/08 312/204 |
| 8,511,761 | B2 | 8/2013 | Numanoglu | |
| 8,651,590 | B2 * | 2/2014 | Wilson | F25D 23/10 312/204 |
| 8,789,900 | B2 * | 7/2014 | Laible | A47B 96/20 312/204 |
| 8,789,902 | B2 | 7/2014 | Hottmann et al. | |
| 9,185,976 | B2 * | 11/2015 | Chen | A47B 88/0055 |
| 9,303,916 | B2 * | 4/2016 | Ozyuksel | F25D 23/10 |
| 9,408,464 | B2 * | 8/2016 | Keeling | A47B 95/00 |
| 9,752,817 | B2 * | 9/2017 | Richards | F25D 23/028 |
| 2004/0222725 | A1 * | 11/2004 | Park | A47B 77/08 312/405 |
| 2013/0257252 | A1 * | 10/2013 | Holzapfel | A47B 88/0055 312/348.4 |
| 2014/0306592 | A1 | 10/2014 | Hottmann et al. | |
| 2015/0184928 | A1 | 7/2015 | Ozyuksel et al. | |
| 2016/0288296 | A1 * | 10/2016 | Bilanzich | B25B 1/12 |
| 2016/0368120 | A1 * | 12/2016 | Hoossainy | B25B 13/14 |

* cited by examiner

A Method 400 for Suspending a Cosmetic Panel onto an Outer Door Panel of an Appliance

COSMETIC DOOR PANEL SUSPENSION AND ADJUSTMENT SYSTEM FOR A BUILT-IN APPLIANCE

FIELD OF THE DEVICE

This device is in the field of cosmetic panels for built-in appliances, more specifically, a suspension and adjustment system for attaching a cosmetic panel to a door panel of an appliance for matching surrounding cabinetry within a kitchen setting.

SUMMARY

In at least one aspect, a cosmetic panel suspension system for an appliance includes an outer door panel having a perimetrical flange. A plurality of side adjusters is attached to the perimetrical flange. At least one adjustment bracket has a plurality of positioning apertures and is in slidable engagement with a portion of the perimetrical flange. The side adjusters extend through respective positioning apertures defined within the at least one adjustment bracket. Adjustment of at least one side adjuster of the plurality of side adjusters slides the at least one adjustment bracket relative to the perimetrical flange. A cosmetic panel is attached to the at least one adjustment bracket.

In at least another aspect, a cosmetic panel suspension system for an appliance includes an outer door panel having a right side flange and a left side flange. Right side adjusters are attached to the right side flange. Left side adjusters are attached to the left side flange. A right adjustment bracket has a plurality of right side apertures defined therein. The right adjustment bracket is in slidable engagement with the right side flange. The right side adjusters extend through respective right side apertures and adjustment of at least one of the right side adjusters slides the right side adjustment bracket relative to the right side flange. A left adjustment bracket has a plurality of left side apertures defined therein. The left adjustment bracket is in slidable engagement with the left side flange. The left side adjusters extend through respective left side apertures, and adjustment of at least one of the left side adjusters slides the left side adjustment bracket relative to the left side flange. A cosmetic panel is attached to the right and left adjustment brackets.

In at least another aspect, a method of suspending a cosmetic panel on an appliance door includes attaching a plurality of side adjusters to a perimetrical flange of an outer door panel. At least one adjustment bracket is disposed over the plurality of side adjusters. The at least one adjustment bracket includes a plurality of positioning apertures that engage a respective side adjuster of the plurality of side adjusters. The at least one adjustment bracket is slidably engaged with the perimetrical flange. A cosmetic panel is disposed in the at least one adjustment bracket, wherein the cosmetic panel is substantially fixed with respect to the at least one adjustment bracket. At least one side adjuster of the plurality of side adjusters is operated to position the at least one adjustment bracket and the cosmetic panel with respect to the outer door panel and at least one adjacent cabinet. The at least one adjustment bracket is secured to the outer door panel to set the position of the cosmetic panel relative to the outer door panel and the at least one adjacent cabinet.

These and other features, advantages, and objects of the present device will be further understood and appreciated by those skilled in the art upon studying the following specification, claims, and appended drawings.

DETAILED DESCRIPTION OF EMBODIMENTS

Figure 1:
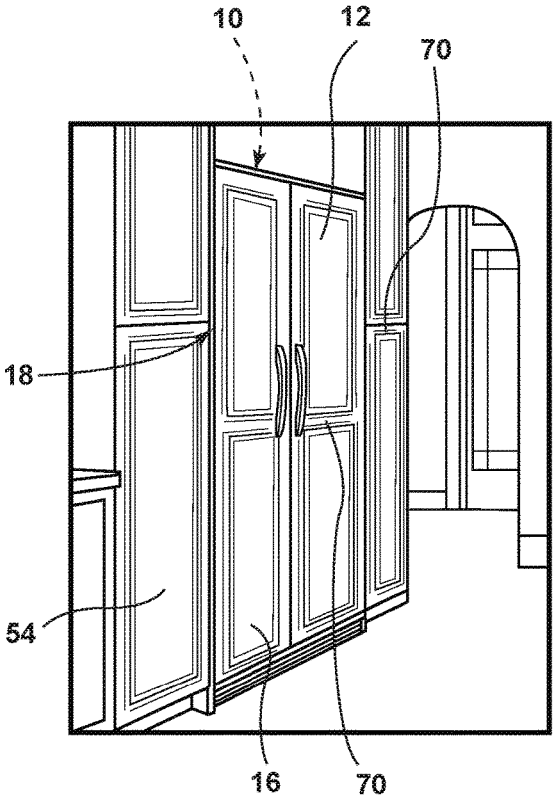
FIG. 1 is a side perspective view of a built-in kitchen appliance incorporated within cabinetry and utilizing an aspect of the cosmetic panel suspension and adjustment system.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As illustrated in FIGS. 1-6, reference numeral 10 generally refers to a suspension and adjustment system for attaching a cosmetic panel 12 to an outer door panel 14 for a door 16 of an appliance 18. According to the various embodiments, the suspension and adjustment system 10 for the cosmetic panel 12 includes an outer door panel 14 that includes a perimetrical flange 20, where the perimetrical flange 20 extends perpendicular to the planar member 22 of the outer door panel 14. According to the various embodiments, the outer door panel 14 can be defined by an outer wrapper of the door or drawer 16 or can be a separate door pan that is attached to the outer wrapper for the door 16. A plurality of side adjusters 24 are attached to the perimetrical flange 20 of the outer door panel 14. At least one adjustment bracket 26 includes a plurality of positioning apertures 28 that slidably engage with a portion of the perimetrical flange 20. It is contemplated that each side adjuster 24 extends into and may extend through respective positioning apertures 28 defined within the adjustment bracket 26. Adjustment of at least one of the side adjusters 24 of the plurality of side adjusters 24 serves to slide the at least one adjustment bracket 26 relative to the perimetrical flange 20. The cosmetic panel 12 can be attached to the at least one adjustment bracket 26 such that adjustment of at least one of the side adjusters 24 to modify the position of the adjustment bracket 26 also serves to modify the position of the cosmetic panel 12 with respect to the outer door panel 14 of the appliance 18. While the term "door" is used to describe the location of the suspension and adjustment system 10 for positioning the cosmetic panel 12, the term "door" should be understood as including any exterior panel of an appliance 18 including doors, drawers, fixed members, vents, and other similar exterior panels that may be operable or fixed.

Referring again to FIGS. 2-6, the plurality of side adjusters 24 can include at least one vertical adjuster 30 and at least one fore-aft adjuster 32. The vertical adjuster 30 and the fore-aft adjuster 32 operates to position the adjustment bracket 26 in the cosmetic panel 12 with respect to the outer door panel 14, which may be defined by the door pan.

Referring again to FIGS. 5-6, the suspension and adjustment system 10 for the cosmetic panel 12 can include an upper fore-aft adjuster 40 positioned at a top portion 42 of the perimetrical flange 20 and a lower fore-aft adjuster 44 positioned at a bottom portion 46 of the perimetrical flange 20. It is contemplated that operation of the upper and lower fore-aft adjusters 40, 44 serves to operate a fore-aft movement 48 and/or a rotational movement 50 of the adjustment bracket 26 and the cosmetic panel 12 relative to the outer door panel 14. The rotational movement 50 of the adjustment bracket 26 can be achieved through modification of only one of the upper and lower fore-aft adjusters 40, 44 such that a top portion 42 of the adjustment bracket 26 moves farther than a bottom portion 46 of the adjustment bracket 26, or vice versa, to achieve a rotational movement 50 of the cosmetic panel 12. Alternatively, similar adjustments of the upper and lower fore-aft adjusters 40, 44 results in a generally lateral fore-aft movement 48 of the adjustment bracket 26 in a direction generally perpendicular to a front surface 52 of the outer door panel 14. The vertical adjusters of the plurality of side adjusters 24 can be manipulated to vertically operate the adjustment bracket 26 and the cosmetic panel 12 in a vertical direction 56 generally parallel with a front surface 52 of the outer door panel 14. Accordingly, operation of the plurality of side adjusters 24 serves to provide a three-dimensional operation of the adjustment bracket 26 and the cosmetic panel 12 with respect to the outer door panel 14. In this manner, the plurality of side adjusters 24 can be manipulated to position the cosmetic panel 12 to be in line with surrounding cabinets 54 and paneling to achieve an aligned appearance of the cosmetic panels 12 of the appliance 18 with the surrounding cabinets 54.

According to the various embodiments, various cosmetic panels 12 can include trim pieces 70 and details that match surrounding cabinets 54. These trim pieces 70 and fine details are intended to align with and/or be level with one another such that the appearance of the appliance 18 is concealed or adapted to fit within the aesthetics of the cabinets 54 surrounding the appliance 18. Where such trim pieces 70 and finite details are out of alignment, the aesthetic appearance can look sloppy or out of place, such that it is highly desired that such details be in alignment after final installation of the appliance 18. Because users view the appliance 18 potentially several times each day, even the slightest misalignment of a cosmetic panel 12 of an appliance 18 with surrounding cabinetry may be readily apparent to the owner of the appliance 18. Accordingly, the suspension and adjustment system 10 described herein provides for finite and precise adjustment of the cosmetic panel 12 to provide for exact alignment of the trim pieces 70 and details of each cosmetic panel 12 with the surrounding cabinets 54.

Referring again to FIGS. 2-6, each positioning aperture 28 of the adjustment brackets 26 can include an inner wall 80 that engages a linear gear 82 of the respective side adjuster 24. It is contemplated that operation of the linear gear 82 biases the inner wall 80 of the positioning aperture 28 relative to a cage 84 of the respective side adjuster 24. In this manner, manipulation of the side adjuster 24 modifies the linear position 86 of the linear gear 82, which in turn presses against the inner wall 80 of the positioning aperture 28 to set the position of the adjustment bracket 26. Accordingly, as the linear gear 82 operates relative to the cage 84, the adjustment bracket 26 also operates with the linear gear 82 relative to the cage 84 of the side adjuster 24. It is also contemplated that the positioning aperture 28 is sized to slidably engage the inner wall 80 with the linear gear 82 in a direction perpendicular to the movement of the linear gear 82. In this manner, as the fore-aft adjusters 32 are manipulated, the adjustment bracket 26 will slide laterally in a fore-aft movement 48 with respect to the side adjusters 24. This fore-aft movement 48 will be in a direction perpendicular to the movement of the linear gear 82 of the vertical adjuster 30. Accordingly, the positioning aperture 28 within which the vertical adjuster 30 is positioned is sized such that the inner wall 80 engaged with the vertical adjuster 30 can slide along the vertical adjuster 30 as the fore-aft adjusters 32 are operated. The same is true for the positioning apertures 28 surrounding the fore-aft adjusters 32. As the vertical adjuster 30 is operated, the inner wall 80 at the fore-aft adjusters 32 slidably engages the linear gear 82 to allow for the three-dimensional movement of the attachment bracket as the fore-aft adjusters 32 and the vertical adjuster 30 are operated. In this manner, the engagement between each side adjuster 24 and the inner wall 80 of the positioning aperture 28 of the adjustment bracket 26 provides for a biasing movement 90 as the linear gear 82 biases the inner wall 80 and a sliding movement 92 to account for movement of the adjustment bracket 26 as the other side adjusters 24 are manipulated.

Referring now to FIGS. 3-10, each side adjuster 24 can include a worm gear 100 that is disposed in a meshing engagement with the linear gear 82. The linear gear 82 is typically in the form of a rack gear 102. The worm gear 100 is linearly fixed and rotationally operable within the cage 84 of a side adjuster 24. It is contemplated that the rack gear 102 is rotationally fixed and linearly operable within the cage 84, such that rotational operation of the worm gear 100 laterally translates the rack gear 102 relative to the cage 84. This lateral translation of the rack gear 102 relative to the cage 84 serves to bias the inner wall 80 of the positioning aperture 28 around the cage 84 to operate the adjustment bracket 26 and provide for the three-dimensional movement generated by the suspension and adjustment system 10. Similarly, the cosmetic panel 12 can be operated in a three-dimensional range of movement to achieve the aligned configuration of the cosmetic panel 12 with respect to the surrounding cabinet 54.

Figure 8:
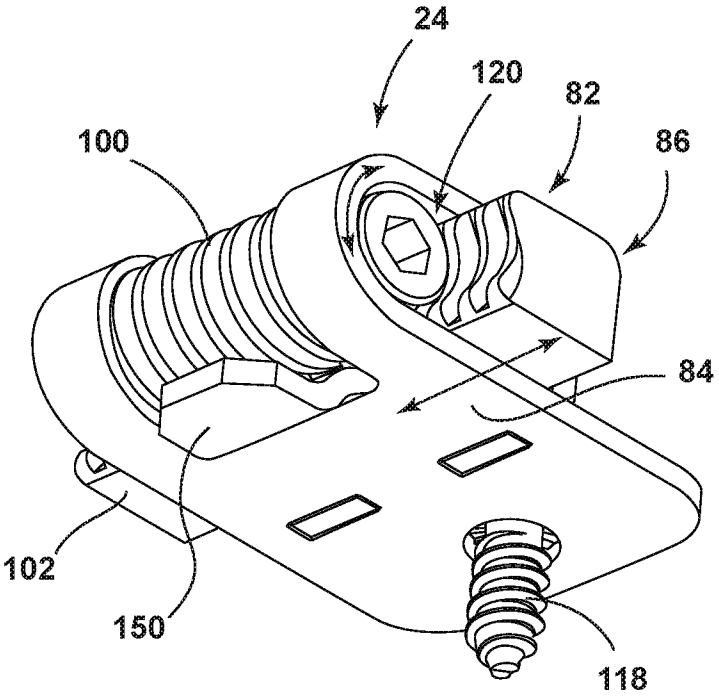
FIG. 8 is a bottom perspective view of the side adjuster of FIG. 7.
Figure 7:
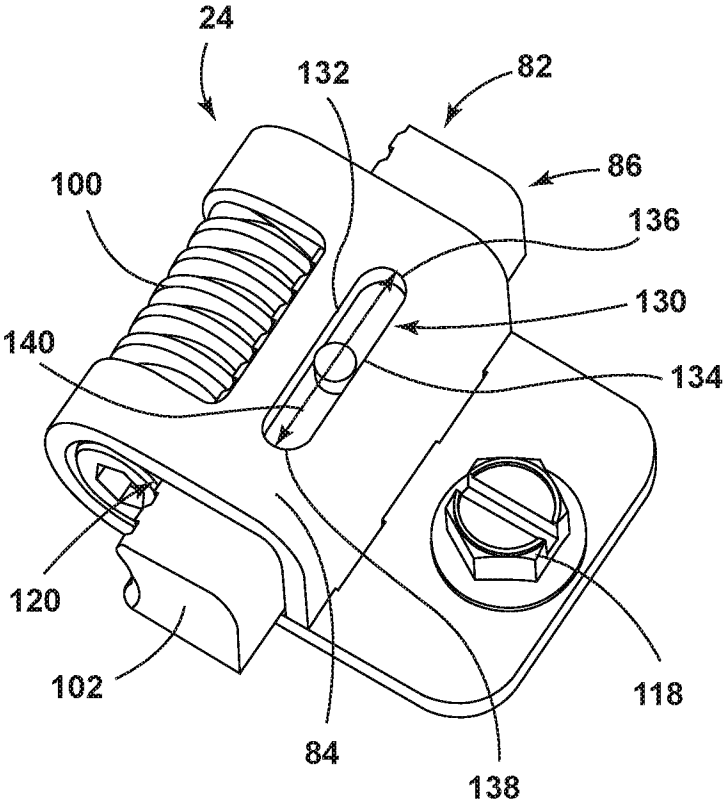
FIG. 7 is a top perspective view of an aspect of a side adjuster incorporating a unitary cage.

As exemplified in FIGS. 7 and 8, the cage 84 can include a single member that surrounds the worm gear 100 and provides for a sliding movement 92 of the rack gear 102 within the cage 84. Accordingly, the cage 84 is formed around the rotationally operable worm gear 100 and the laterally operable rack gear 102 such that each are contained therein and are not removable from the cage 84 without bending or otherwise deforming or damaging the cage 84 to extract the worm gear 100 and the rack gear 102 therefrom.

Figure 10:
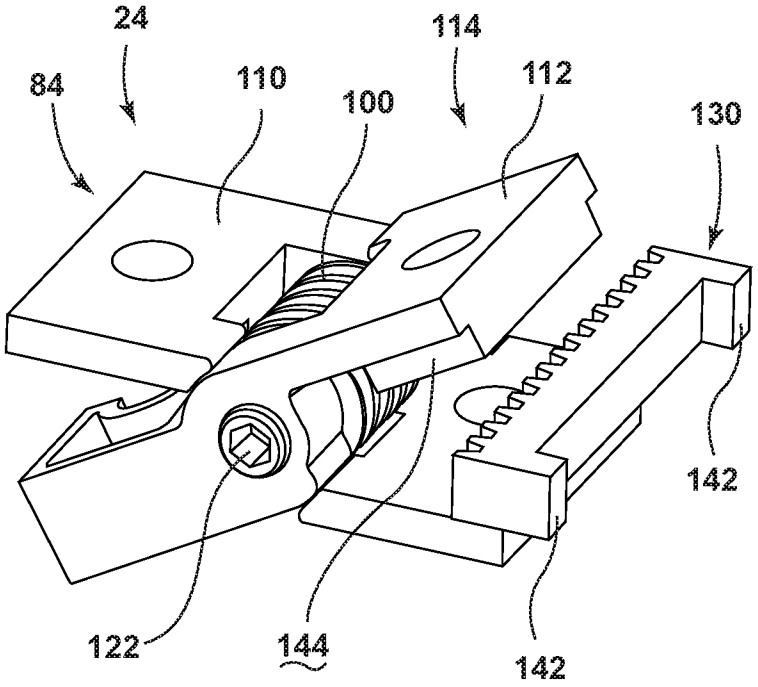
FIG. 10 is a top perspective view of the side adjuster of FIG. 9 with the cage in an assembly position.
Figure 9:
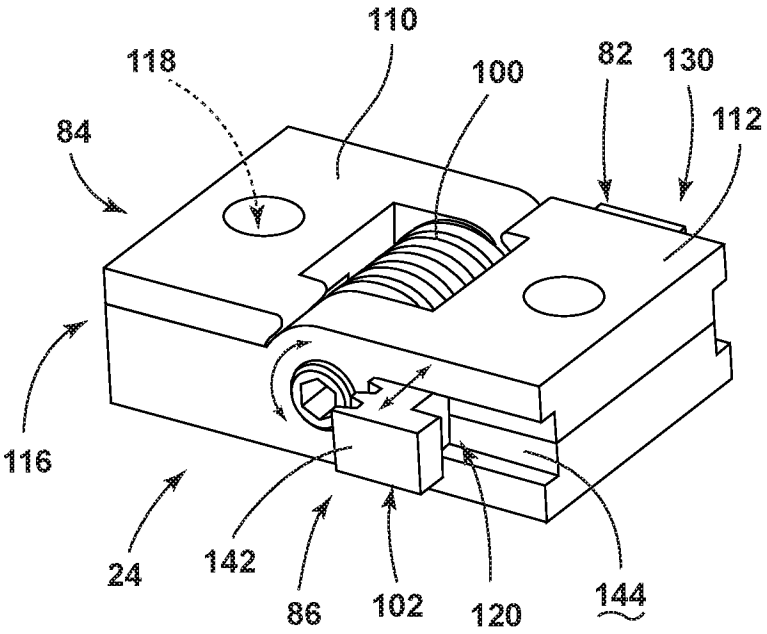
FIG. 9 is a top perspective view of a side adjuster having a two-part cage shown in an operating position.
Figure 12:
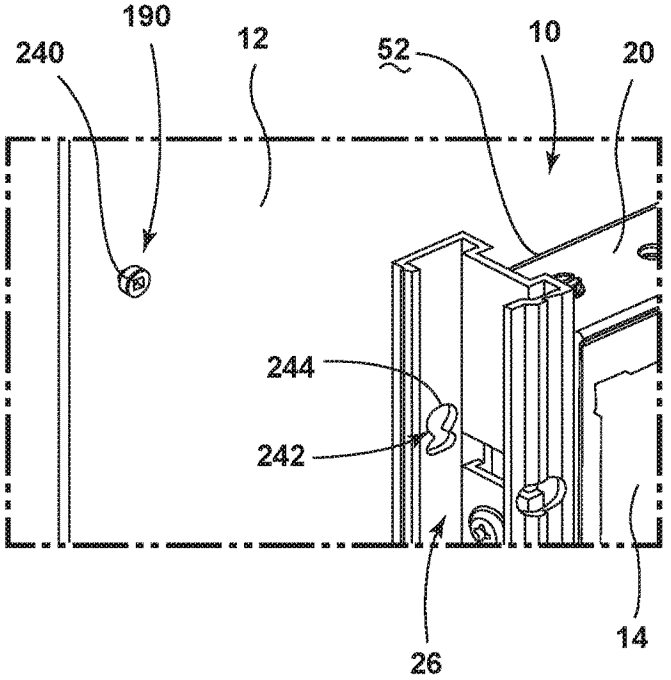
FIG. 12 is an enlarged perspective view of the cosmetic panel suspension and adjustment system of FIG. 11 taken at area XII.
Figure 11:
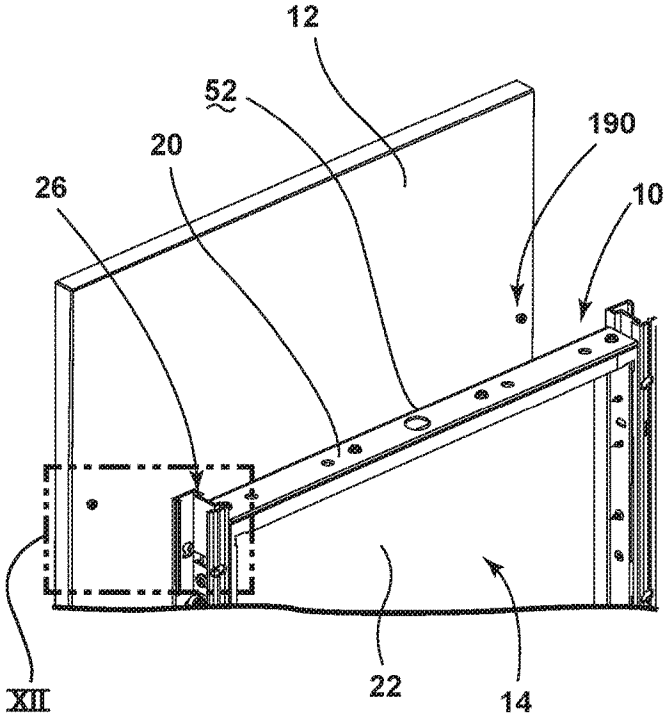
FIG. 11 is a top perspective view of an aspect of the cosmetic panel suspension and adjustment system showing attachment of the cosmetic panel to the adjustment bracket.
Figure 13:
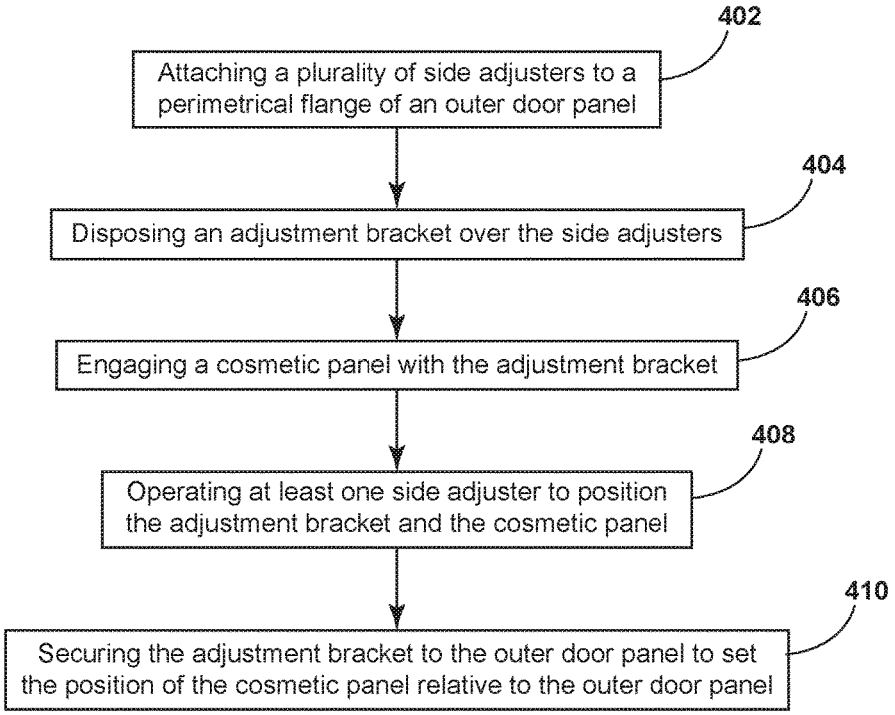
FIG. 13 is a schematic flow diagram illustrating a method of suspending a cosmetic panel on an appliance door.

Referring now to FIGS. 9 and 10, the cage 84 can include first and second cage members 110, 112 that are rotationally operable relative to one another between an assembly position 114 and an operating position 116. The first and second cage members 110, 112 are rotationally operable about the worm gear 100. In such an embodiment, the first and second cage members 110, 112 in the assembly position 114 provide for insertion and removal of the rack gear 102 from the meshing engagement with the worm gear 100. The worm gear 100 is laterally fixed between the first and second cage members 110, 112 such that the worm gear 100 also operates as a hinge 122 around which the first and second cage members 110, 112 operate. Once the rack gear 102 is placed in meshing engagement with the worm gear 100, the first and second cage members 110, 112 can be rotated to the operating position 116 such that the rack gear 102 is rotationally fixed in a meshing engagement with the worm gear 100 and allowed to laterally translate between the first and second cage members 110, 112 as a result of rotational operation of the worm gear 100. It is contemplated that the first and second cage members 110, 112 can be coupled together when the side adjuster 24 is attached to the perimetrical flange 20. Accordingly, the first and second cage members 110, 112 are configured to receive the fasteners 118 that attach the side adjuster 24 to the perimetrical flange 20 and also fix the side adjuster 24 in the operating position 116 to prevent removal of the rack gear 102 from meshing engagement with the worm gear 100.

Referring again to FIGS. 9 and 10, the first and second cage members 110, 112 in the operating position 116 define a rack gear slot 120 within which the rack gear 102 is rotationally secured and laterally translates in response to rotation of the worm gear 100. Alternatively, the assembly position 114 of the first and second cage members 110, 112 provides for selective removal of the rack gear 102 from the cage 84 or placement therein.

Referring again to FIGS. 7-10, it is contemplated that the rack gear 102 can include at least one tab 130 that slidably engages a portion of the cage 84. In this manner, the at least one tab 130 serves to limit the linear translation of the rack gear 102 within the cage 84 and prevents overtranslation of the rack gear 102 such that the rack gear 102 leaves the cage 84. Engagement of the at least one tab 130 with the cage 84 defines the range of linear translation 140 of the rack gear 102 within the cage 84. In the aspects of the device exemplified in FIGS. 7 and 8, the tab 130 can be centrally disposed on the rack gear 102 and the cage 84 can include a tab slot 132 that engages the at least one tab 130. In such an embodiment, the tab 130 can be defined by a protrusion 134 that extends from a central portion of the rack gear 102 and extends into the tab slot 132. It is contemplated that slidable movement of the protrusion 134 within the tab slot 132 between first and second ends 136, 138 of the tab slot 132 corresponds to the range of linear translation 140 of the rack gear 102 due to operation of the worm gear 100 of the side adjuster 24. As exemplified in FIGS. 9 and 10, the at least one tab 130 of the rack gear 102 can include end tabs 142 that are configured to engage an exterior 144 of the side adjuster 24 to define the range of linear translation 140 of the rack gear 102.

Referring again to FIGS. 2-10, it is contemplated that the side adjuster 24 can be directly attached to a portion of the perimetrical flange 20. In such an embodiment, the cage 84 can include an extension member 150 that extends from the cage 84 and through a portion of the perimetrical flange 20 to at least partially secure the side adjuster 24 to the perimetrical flange 20. Final positioning of each side adjuster 24 can be accomplished through a fastener 118 that extends through a portion of the cage 84 and into the perimetrical flange 20.

Figure 2:
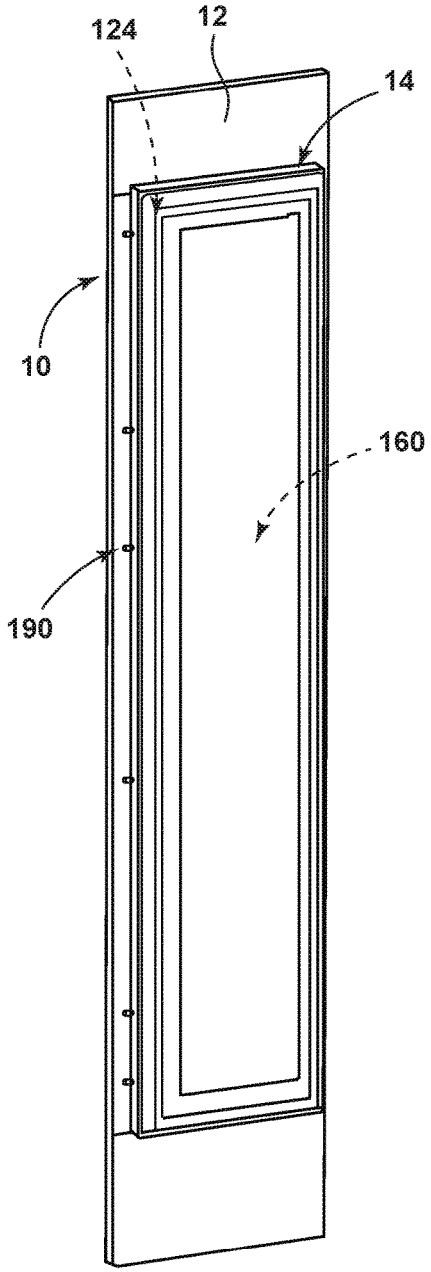
FIG. 2 is a rear perspective view of a door panel for an appliance attached to a cosmetic panel and incorporating an aspect of the cosmetic panel suspension and adjustment system.
Figure 3:
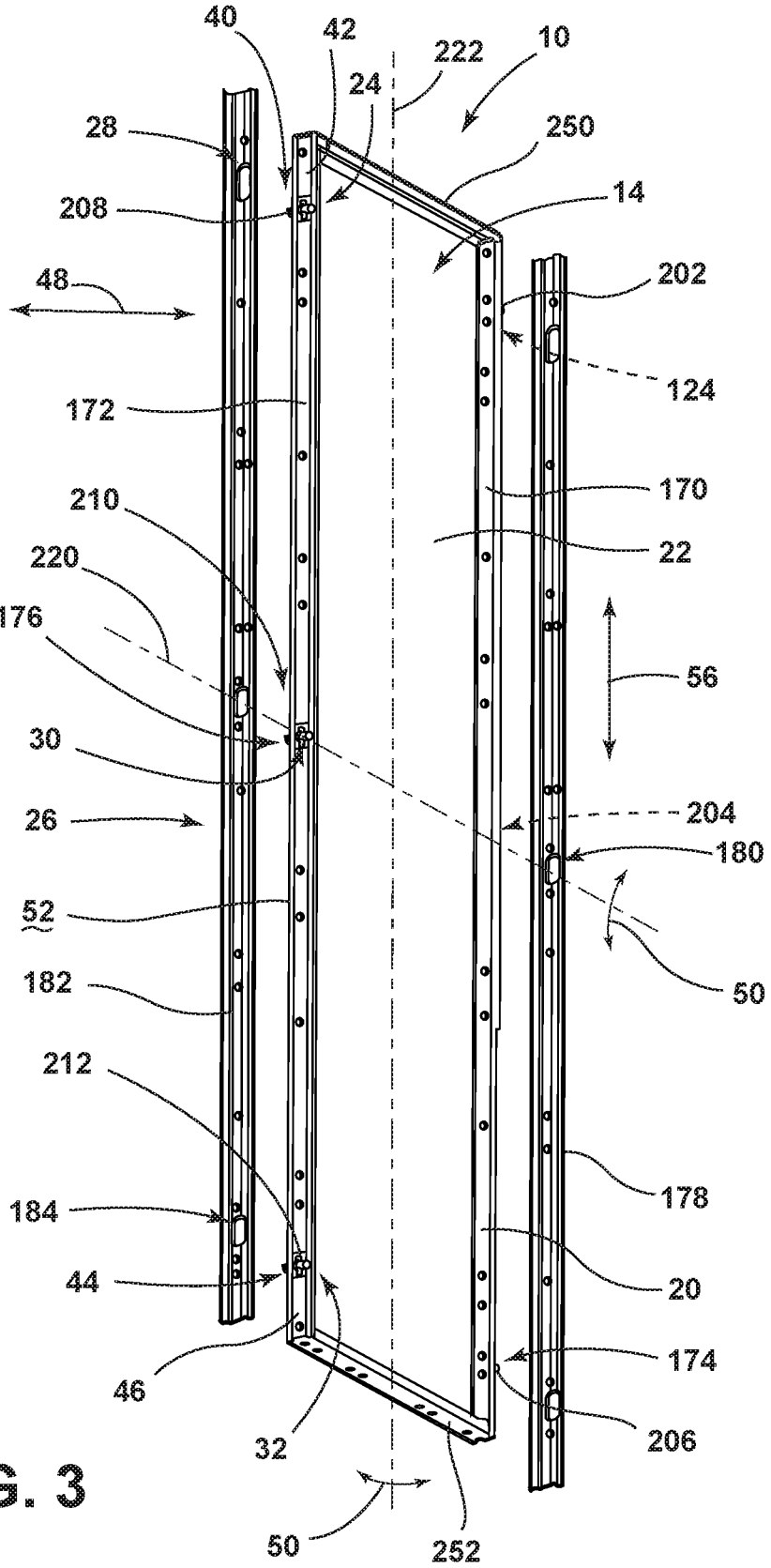
FIG. 3 is a partially exploded bottom perspective view of an outer door panel of an appliance with the right and left attachment brackets separated therefrom and the side adjusters attached to the perimetrical flange of the outer door panel.
Figure 4:
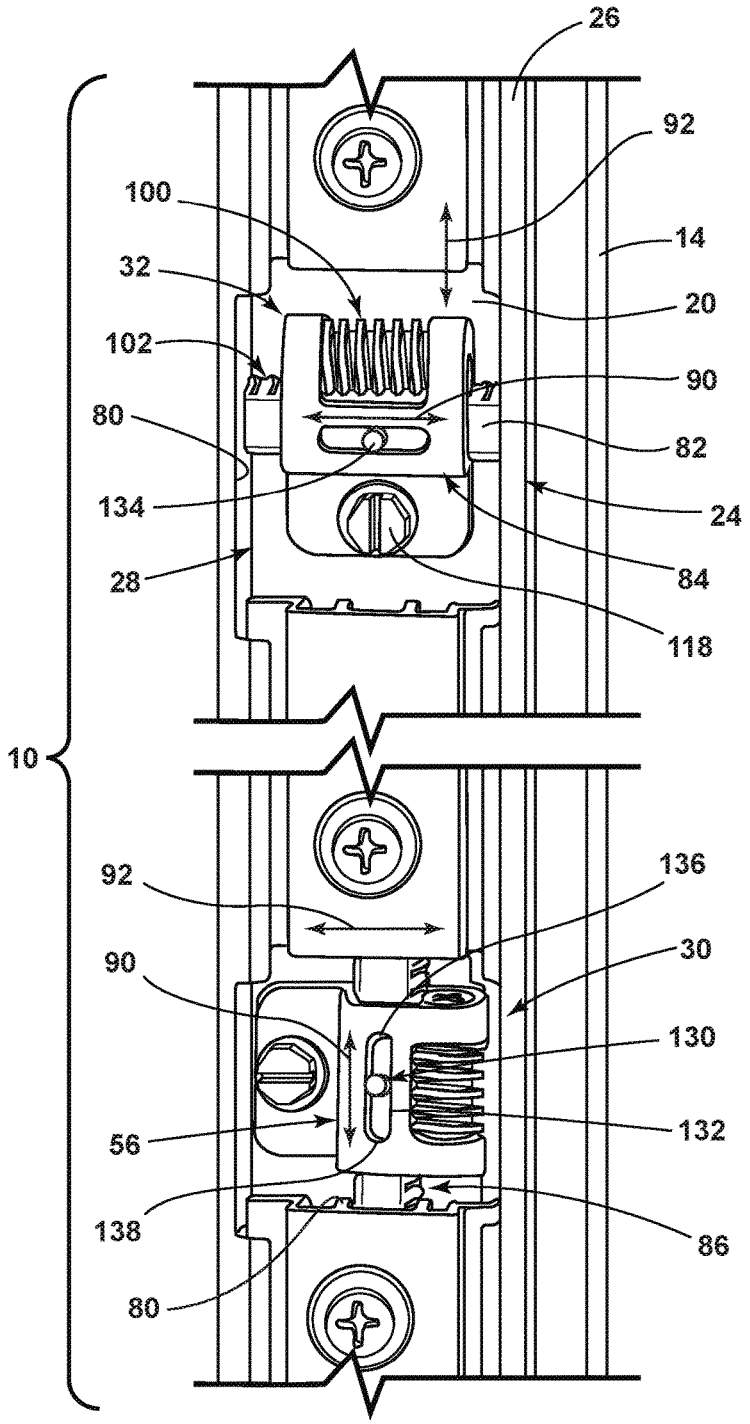
FIG. 4 is a side perspective view of an aspect of the cosmetic panel suspension and adjustment system illustrating the side adjusters set within the various cutouts of the adjustment bracket.
Figure 5:
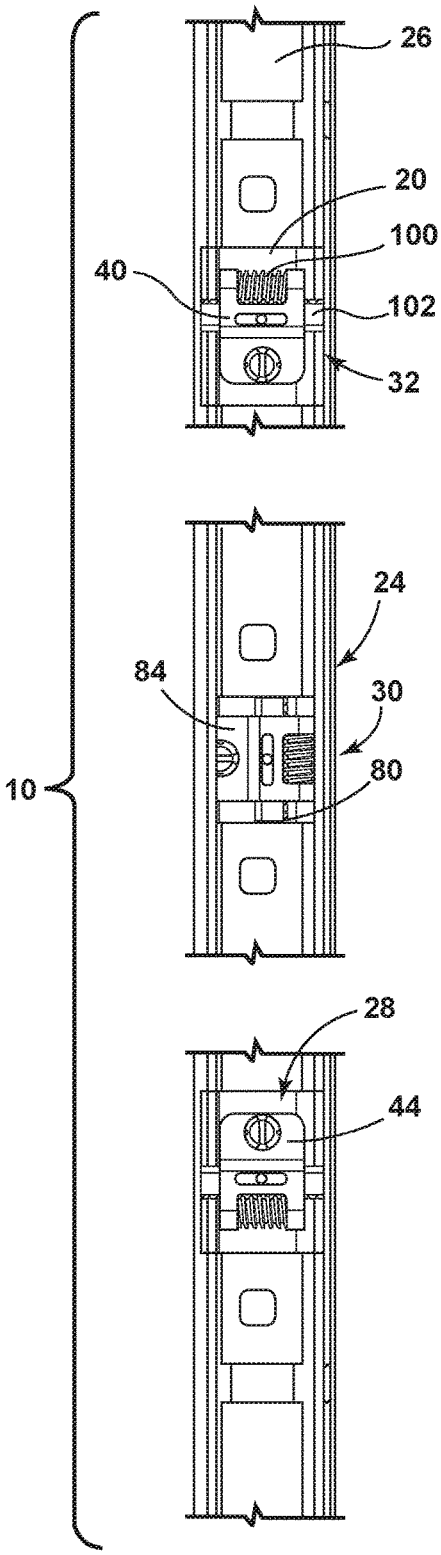
FIG. 5 is an elevational view showing a first position of the adjustment bracket relative to the various side adjusters for the cosmetic panel suspension adjustment system.
Figure 6:
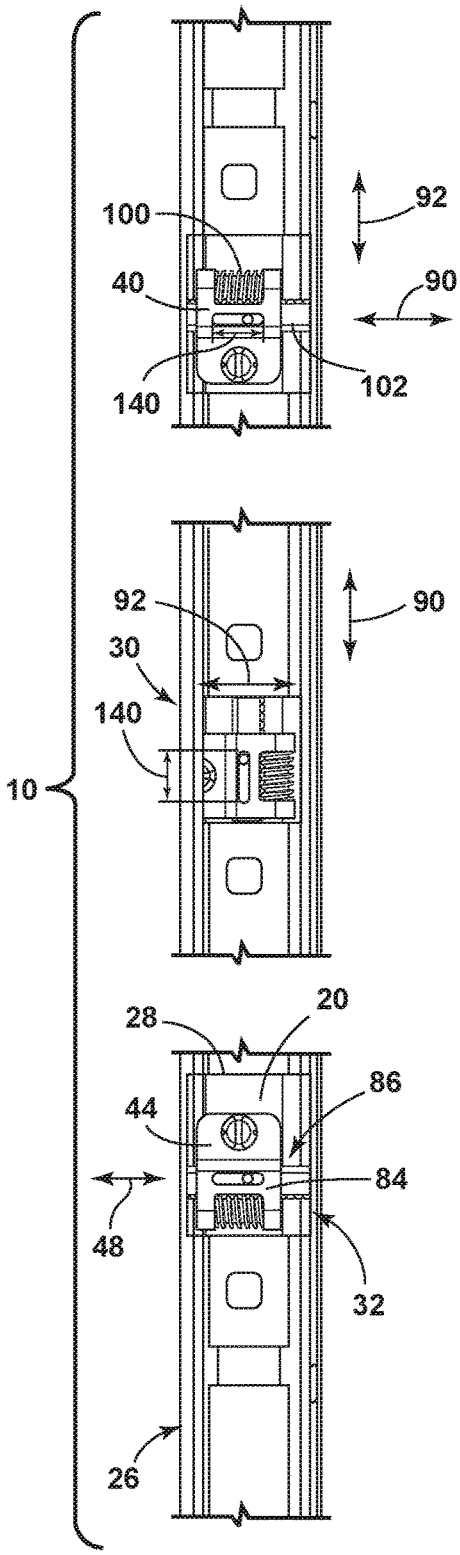
FIG. 6 is an elevational view of the cosmetic panel suspension and adjustment system of FIG. 5 exemplifying adjustment of the various side adjusters within the cutouts of the adjustment bracket.

According to the various embodiments, as exemplified in FIGS. 1-3, the inclusion of the door pan in addition to the outer wrapper of the door 16 can serve to provide an attachment location for the various side adjusters 24 to the perimetrical flange 20. As a fastener 118 is engaged with the perimetrical flange 20, the fastener 118 may extend through the perimetrical flange 20. Such attachment directly to an outer wrapper of a door 16 may result in a fastener 118 puncturing an insulation member 160 of the door 16 such as a vacuum insulated structure. Such a puncture may result in a loss of vacuum and insulating capacity within the insulating member of the door or drawer 16. It is also contemplated that where a door pan is not used and the side adjusters 24 are attached directly to the outer wrapper of the door 16, the door 16 can include attachment recesses 124 that separate the fastener 118 from an insulation member 160, such that puncturing of the insulation member 160 is prevented through separation of the attachment recess 124 of the outer wrapper and the insulation member 160.

Referring again to FIGS. 1-10, the suspension and adjustment system 10 for attaching the cosmetic panel 12 to the door panel can include an outer door panel 14, in the form of a door pan that include a right side flange 170 and a left side flange 172. A set of right side adjusters 174 can be attached to the right side flange 170 and a set of left side adjusters 176 can be attached to the left side flange 172. A right adjustment bracket 178 having a plurality of right side apertures 180 defined therein can be placed in slidable engagement with the right side flange 170. The right side adjusters 174 extend through respective right side apertures 180. Adjustment of at least one of the right side adjusters 174 serves to slide the right side adjustment bracket 26 relative to the right side flange 170. A left adjustment bracket 182 can include a plurality of left side apertures 184 defined therein. The left adjustment bracket 182 is placed in slidable engagement with the left side flange 172, wherein the left side adjusters 176 extended through respective left side apertures 184. Adjustment of at least one of the left side adjusters 176 serves to slide the left adjustment bracket 182 relative to the left side flange 172. The cosmetic panel 12 can then be attached to the right and left adjustment brackets 178, 182.

Referring again to FIGS. 2-12, the cosmetic panel 12 can include a plurality of panel connectors 190 that extend from an interior surface of the cosmetic panel 12. The plurality of panel connectors 190 are adapted to engage the right and left adjustment brackets 178, 182 and selectively secure the cosmetic panel 12 to the right and left adjustment brackets 178, 182. It is contemplated that adjustment of the right and left side adjusters 174, 176 operates the position of the right and left adjustment brackets 178, 182 and, in turn, the position of the cosmetic panel 12 relative to the outer door panel 14.

Referring again to FIGS. 2-6, the right side adjusters 174 can include a right top adjuster 202, a right center adjuster 204 and a right bottom adjuster 206, and the left side adjusters 176 can include a left top adjuster 208, a left center adjuster 210 and a left bottom adjuster 212. It is contemplated that the right and left center adjusters 204, 210 are adapted to vertically operate the right and left adjustment brackets 178, 182, respectively, relative to the outer door panel 14. As discussed above, the right and left side apertures 180, 184 of the right and left adjustment brackets 178, 182 are sized such that vertical operation of the right and left center adjusters 204, 210 provides for movement of the right and left adjustment brackets 178, 182 around the right and left top adjusters 202, 208 and the right and left bottom adjusters 206, 212. Accordingly, operation of any one of the side adjusters 24 does not substantially prevent operation of any one of the other side adjusters 24 of the suspension and adjustment system 10 for modifying the position of the cosmetic panel 12. As discussed above, the right and left top adjusters 202, 208 and the right and left bottom adjusters 206, 212 are adapted to control fore-aft movement 48 and rotational movement 50 to operate the right and left adjustment brackets 178, 182, respectively, relative to the outer door panel 14. It is also contemplated that the right and left center adjusters 204, 210 can provide for limited rotational movement 50 within a plane parallel with the front surface 52 of the outer door panel 14. In this manner, operation of only one of the right and left center adjusters 204, 210 may vertically translate only one of the right and left adjustment brackets 178, 182, such that the movement of only one of the right and left adjustment brackets 178, 182 corresponds to a rotational movement 50 of the cosmetic panel 12 within a plane parallel with or substantially parallel with a front surface 52 of the outer door panel 14.

Referring again to FIGS. 2-6, lateral operation or fore-aft movement 48 of the right and left adjustment brackets 178, 182 is in a direction generally perpendicular to the front surface 52 of the outer door panel 14. Accordingly, rotational movement 50 of the right and left adjustment brackets 178, 182 is at least about a horizontal axis 220 extending perpendicularly between the right and left adjustment brackets 178, 182. It is contemplated that rotational movement 50 of the cosmetic panel 12 can also be about a vertical axis 222 extending parallel with and between the right and left adjustment brackets 178, 182. As discussed above, rotational movement 50 of the cosmetic panel 12 can also be as a result of operation of one of the right and left center adjusters 204, 210, or greater operation of one of the right and left center adjusters 204, 210 as compared to the other of the right and left center adjusters 204, 210. Similarly, rotational operation of the adjustment brackets 26, and in turn, the cosmetic panel 12, in a direction generally perpendicular to a front surface 52 of the outer door panel 14 can be achieved through operation of the right and left top adjusters 202, 208 and the right and left bottom adjusters 206, 212, such that a top portion 42 of the adjustment brackets 26 operates a different distance than a bottom portion 46 of the right and left adjustment brackets 178, 182. As discussed above, this varying operation of the various side adjusters 24 serves to provide for three-dimensional operation of the adjustment brackets 26 and the cosmetic panel 12 relative to a front surface 52 of the outer door panel 14.

Referring now to FIGS. 1-13, having described various aspects of the suspension and adjustment system 10 for attaching a cosmetic panel 12 to an outer door panel 14 for an appliance 18, a method 400 is disclosed for suspending a cosmetic panel 12 onto an appliance door 16 utilizing an aspect of the suspension and adjustment system 10. According to the method 400, a plurality of side adjusters 24 is attached to a perimetrical flange 20 of the outer door panel 14 (step 402). Once the side adjusters 24 are in place, at least one adjustment bracket 26 is disposed over the plurality of side adjusters 24 (step 404). The adjustment bracket 26 can include a plurality of positioning apertures 28. Each positioning aperture 28 is configured to engage with a respective side adjuster 24 of the plurality of side adjusters 24. Through this engagement, the adjustment bracket 26 is placed in slidable engagement with the perimetrical flange 20. It is contemplated that the perimetrical flange 20 can include right and left side flanges 170, 172 that slidably engage right and left adjustment brackets 178, 182.

Referring again to FIGS. 1-13, with the adjustment brackets 26 in place, a cosmetic panel 12 is disposed in engagement with the at least one adjustment bracket 26 (step 406). It is contemplated that the cosmetic panel 12 can, at least initially, be loosely attached to the adjustment brackets 26 such that the various side adjusters 24 can be manipulated to properly position the cosmetic panel 12 and the adjustment brackets 26 relative to the surrounding cabinets 54. Accordingly, once the cosmetic panel 12 is at least partially fixed with respect to the adjustment bracket 26, the various side adjusters 24 are operated to position the adjustment bracket 26 and the cosmetic panel 12 with respect to the front surface 52 of the outer door panel 14 and at least one adjacent cabinet 54 (step 408). Once proper positioning of the cosmetic panel 12 is achieved, the various adjustment brackets 26 are secured to the cosmetic panel 12 to prevent unwanted movement of the cosmetic panel 12 with respect to the various portions of the suspension and adjustment system 10 (step 410). According to the various embodiments, it is also contemplated that various adjustment brackets 26 can also be secured through fasteners 118 or other various attachment mechanisms to the perimetrical flange 20 once the final positioning of the cosmetic panel 12 is achieved.

According to the various embodiments, the plurality of panel connectors 190 can be in the form of screws or studs that have an attachment head 240 that is configured to engage a portion of the adjustment bracket 26. The adjustment bracket 26 can include a fastening slot 242 having an enlarged portion 244 through which the head of the panel connector 190 can be inserted. Once inserted therethrough, the panel fastener 118 can slide within a portion of the fastening slot 242, such that the cosmetic panel 12 can hang from the adjustment brackets 26 for easy positioning before the cosmetic panel 12 is secured to the adjustment brackets 26 and to the outer door panel 14.

According to the various embodiments, it is contemplated that the various side adjusters 24 of the suspension and adjustment system 10 can be configured to operate the adjustment bracket 26 and the cosmetic panel 12 in a linear direction within a range of approximately 10 millimeters, or 5 millimeters in both directions. By way of example, and not limitation, the right and left center adjusters 204, 210 can manipulate the right and left adjustment brackets 178, 182 from a base position vertically up a distance of approximately 5 millimeters or vertically down a distance of approximately 5 millimeters. The other side adjusters 24 of the suspension and adjustment system 10 can operate along similar distances to modify the positioning of the adjustment brackets 26 and the cosmetic panel 12 with respect to the outer door panel 14. It is contemplated that the horizontal adjustment of the cosmetic panel 12 can either be by hand or can be performed according to side adjusters 24 positioned on the top and bottom flanges 250, 252 of the perimetrical flange 20. These side adjusters 24 positioned on top and bottom flanges 250, 252 of the perimetrical flange 20 can be manipulated to provide horizontal adjustment through a plane substantially parallel with a front surface 52 of the outer door panel 14. In such an embodiment, it is contemplated that the depth of the inner wall 80 of the positioning aperture 28 is such that the adjustment bracket 26 can be manipulated in three dimensions around each side adjuster 24 to account for manipulation of the various side adjusters 24 on the right and left side flanges 170, 172 and the top and bottom flanges 250, 252 of the perimetrical flange 20.

According to the various embodiments, the various use of the side adjusters 24 serves to provide for very minute and precise adjustment of portions of the adjustment brackets 26 and, in turn, precise modification of the position of the cosmetic panel 12 with respect to the outer door panel 14 and the surrounding cabinets 54. Accordingly, the suspension and adjustment system 10 disclosed herein provides for precise alignment of the cosmetic panel 12 with respect to the surrounding cabinets 54.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A cosmetic panel suspension system for an appliance, the cosmetic panel suspension system comprising:

an outer door panel having a perimetrical flange;

a plurality of side adjusters attached to the perimetrical flange, wherein each side adjuster includes a worm gear disposed in a meshing engagement with a rack gear, wherein the worm gear is linearly fixed and rotationally operable within a cage, and wherein the rack gear is rotationally fixed and linearly operable within the cage such that rotational operation of the worm gear laterally translates the rack gear relative to the cage, wherein the cage includes first and second cage members that are rotationally operable relative to one another between an open assembly position and a closed operation position, the first and second cage members being rotationally operable about the worm gear, wherein the worm gear slidably operates the rack gear in the closed operating position;

at least one adjustment bracket having a plurality of positioning apertures in slidable engagement with a portion of the perimetrical flange, wherein the plurality of side adjusters extends through respective positioning apertures defined within the at least one adjustment bracket, and wherein adjustment of at least one side adjuster of the plurality of side adjusters slides the at least one adjustment bracket relative to the perimetrical flange; and a cosmetic panel attached to the at least one adjustment bracket.

2. The cosmetic panel suspension system of claim 1, wherein the plurality of side adjusters includes at least one vertical adjuster and at least one fore-aft adjuster, wherein the at least one vertical adjuster and the at least one fore-aft adjuster operates to position the at least one adjustment bracket and the cosmetic panel with respect to the outer door panel.

3. The cosmetic panel suspension system of claim 2, wherein the at least one fore-aft adjuster includes an upper fore-aft adjuster positioned at a top portion of the perimetrical flange and a lower fore-aft adjuster positioned at a bottom portion of the perimetrical flange, and wherein operation of the upper and lower fore-aft adjusters operates a fore-aft movement and a rotational movement of the at least one adjustment bracket and the cosmetic panel relative to the outer door panel.

4. The cosmetic panel suspension system of claim 1, wherein each positioning aperture of the plurality of positioning apertures includes an inner wall that engages a linear gear of the respective side adjuster, wherein operation of the linear gear biases the inner wall of the positioning aperture relative to a cage of the respective side adjuster, and wherein the positioning aperture is sized to slidably engage the inner wall with the linear gear in a direction perpendicular to movement of the linear gear.

5. The cosmetic panel suspension system of claim 1, wherein the first and second cage members in the closed operating position define a rack gear slot within which the rack gear is rotationally secured and laterally translates in response to rotation of the worm gear, and wherein the open assembly position of the first and second cage members provides for selective removal of the rack gear from the cage.

6. The cosmetic panel suspension system of claim 1, wherein the rack gear includes at least one tab that slidably engages a portion of the cage, and wherein the engagement of the at least one tab with the cage defines a range of linear translation of the rack gear within the cage.

7. The cosmetic panel suspension system of claim 6, wherein the cage defines a tab slot and the at least one tab includes a protrusion extending from the rack gear and into the tab slot, wherein slidable movement of the protrusion within the tab slot between first and second ends of the tab slot, corresponds to the range of linear translation of the rack gear.

8. The cosmetic panel suspension system of claim 1, wherein the cage is directly attached to a portion of the perimetrical flange.

9. A cosmetic panel suspension system for an appliance, the cosmetic panel suspension system comprising:

an outer door panel having a right side flange and a left side flange;

right side adjusters attached to the right side flange;

left side adjusters attached to the left side flange;

a right adjustment bracket having a plurality of right side apertures defined therein, the right adjustment bracket in slidable engagement with the right side flange, wherein the right side adjusters extend through respective right side apertures, and wherein adjustment of at least one of the right side adjusters slides the right adjustment bracket relative to the right side flange;

a left adjustment bracket having a plurality of left side apertures defined therein, the left adjustment bracket in slidable engagement with the left side flange, wherein the left side adjusters extend through respective left side apertures, and wherein adjustment of at least one of the left side adjusters slides the left adjustment bracket relative to the left side flange; and a cosmetic panel attached to the right and left adjustment brackets, wherein each of the right and left side apertures includes an inner wall that slidably engages a linear gear of the respective right and left side adjusters, wherein operation of the linear gear biases the inner wall of the respective positioning aperture relative to a cage of the respective right and left side adjusters, wherein each cage of the respective right and left side adjusters selectively operates linearly and rotationally within the respective positioning aperture, and wherein operation of each cage of the respective right and left side adjusters selectively and rotationally operates the cosmetic panel about two separate and generally perpendicular axes of rotation.

10. The cosmetic panel suspension system of claim 9, further comprising:

a plurality of panel connectors that extend from an interior surface of the cosmetic panel, wherein the plurality of panel connectors are adapted to engage the right and left adjustment brackets and selectively secure the cosmetic panel to the right and left adjustment brackets, wherein adjustment of the right and left side adjusters operates a position of the right and left adjustment brackets and the cosmetic panel relative to the outer door panel.

11. The cosmetic panel suspension system of claim 9, wherein the right side adjusters include a right top adjuster, a right center adjuster and a right bottom adjuster, and wherein the left side adjusters include a left top adjuster, a left center adjuster and a left bottom adjuster, wherein the right and left center adjusters are adapted to vertically operate the right and left adjustment brackets, respectively, relative to the outer door panel.

12. The cosmetic panel suspension system of claim 11, wherein the right and left top adjusters and the right and left bottom adjusters are adapted to laterally and rotationally operate the right and left adjustment brackets, respectively, relative to the outer door panel.

13. The cosmetic panel suspension system of claim 12, wherein lateral operation of the right and left adjustment brackets is in a direction generally perpendicular to a front surface of the outer door panel, and wherein rotational operation of the right and left adjustment brackets is about at least one of a horizontal axis extending perpendicularly and between the right and left adjustment brackets and a vertical axis extending parallel with and between the right and left adjustment brackets.

14. The cosmetic panel suspension system of claim 9, wherein the linear gear is a rack gear, and wherein each of the right and left side adjusters includes a worm gear disposed in a meshing engagement with the rack gear, wherein the worm gear is linearly fixed and rotationally operable within the cage, and wherein the rack gear is rotationally fixed and linearly operable within the cage such that rotational operation of the worm gear laterally translates the rack gear relative to the cage.

* * * * *